US005447787A

United States Patent [19]

Shaffer

[11] Patent Number: 5,447,787

[45] Date of Patent: Sep. 5, 1995

[54] REINFORCED FABRIC

[75] Inventor: Donald E. Shaffer, Wilmington, Del.

[73] Assignee: E. I. Du Pont de Nemours and Company, Wilmington, Del.

[21] Appl. No.: 380,489

[22] Filed: Jan. 30, 1995

[51] Int. Cl.[6] ..... B32B 5/08; B32B 25/12; D03D 1/00; D03D 15/00

[52] U.S. Cl. ..... 428/229; 139/35; 139/410; 139/413; 139/414; 139/426 R; 139/420 A; 428/233; 428/255; 428/257; 428/258; 428/267; 428/272; 428/340; 428/902; 428/920

[58] Field of Search ..... 139/35, 410, 413, 414, 139/426 R, 420 A; 428/229, 233, 255, 257, 258, 267, 272, 902, 920, 340

[56] References Cited

U.S. PATENT DOCUMENTS 4,900,613 4/1989 Green ..... 428/225
4,941,884 10/1989 Green ..... 8/120

FOREIGN PATENT DOCUMENTS 59-9053 1/1984 Japan .
62-26900 6/1987 Japan .
2025789 7/1978 United Kingdom .

*Primary Examiner*—James C. Cannon

[57] ABSTRACT

A reinforced fabric composed of a background fabric and a reinforcing grid that is joined to the background fabric so that the grid reinforced fabric is at least 20% stronger than a fabric into which reinforcing yarns of the same type and weight percent as that of the grid have been integrally woven.

10 Claims, 3 Drawing Sheets

REINFORCED FABRIC

BACKGROUND OF THE INVENTION

Light weight, tear resistant fabric is desired for many purposes including, but not exclusively, tents, tarps, awnings, canopies, marine coverings and banners. Attempts to provide fabrics suitable for these uses have included laminating or coating the fabric with resinous material such as rubber. Another solution to the problem of improving fabric tear resistance includes weaving the fabric itself from yarns known for their strength such as yarns made from poly(p-phenylene terephthalamide), PPD-T and poly(m-phenylene isophthalamide), MPD-I.

Laminated fabrics, even those reinforced by using some percentage of yarns either made from staple fibers or filaments of PPD-T or MPD-I such as described in Japanese Publication Kokoku Sho 62-26900, have not met the need of providing a tear resistant, light weight and economical fabric. In particular laminated fabrics do not breath, that is they do not allow moisture vapor to pass though the fabric. This is especially a problem in fabrics used as tent material or for coverings that must allow passage of vapor.

Consider tents, for example, made of coated or laminated fabrics. In cold climates or on cold nights, water vapor, which is the natural product of cooking and normal life activities, remains within the space enclosed under a laminated fabric tent. Heating causes the water vapor to rise to the top of the enclosed area where the water vapor is cooled by contacting the cold laminated surface. Moisture then condenses on this cooler surface as droplets that can rain or weep down on the tent occupants. Additionally when laminated or coated fabric is sewn into tents or products for other uses, the laminated or coated fabric does not self seal around the holes made in the fabric by the sewing needle. Holes remain open along seams, hems and other stitched areas. If this sewn laminated fabric cover is used outside, moisture from rain or other wet weather conditions can flow through the needle holes allowing moisture to reach whatever the cover was designed to protect. Finally laminated or coated fabric is generally not light weight or flexible making it difficult to move, fold, store and handle.

A non laminated fabric may be acceptable for a variety of purposes, particularly if the fabric is strong and tear resistant. Fabrics made entirely of very strong polymer fibers such as those made from PPD-T, or MPD-I, may provide sufficient strength, but may be more costly than is practical for the planned end use.

SUMMARY OF THE INVENTION

The present invention provides a reinforced fabric made of a background fabric joined to a reinforcing grid. The number of yarn ends per inch(2.54 cm) in the reinforcing grid is less than 15% of the number of yarn ends per inch(2.54 cm) in the background fabric. The reinforcing grid is joined at infrequently spaced points to at least one face of the background fabric. The resulting reinforced fabric is at least 20% stronger, as measured by Elmendorf Tear Strength (ASTM D1424), than a similar reinforced fabric made simply by weaving the reinforcing yarns directly into the background fabric.

DETAILED DESCRIPTION OF THE INVENTION

Figure 1:
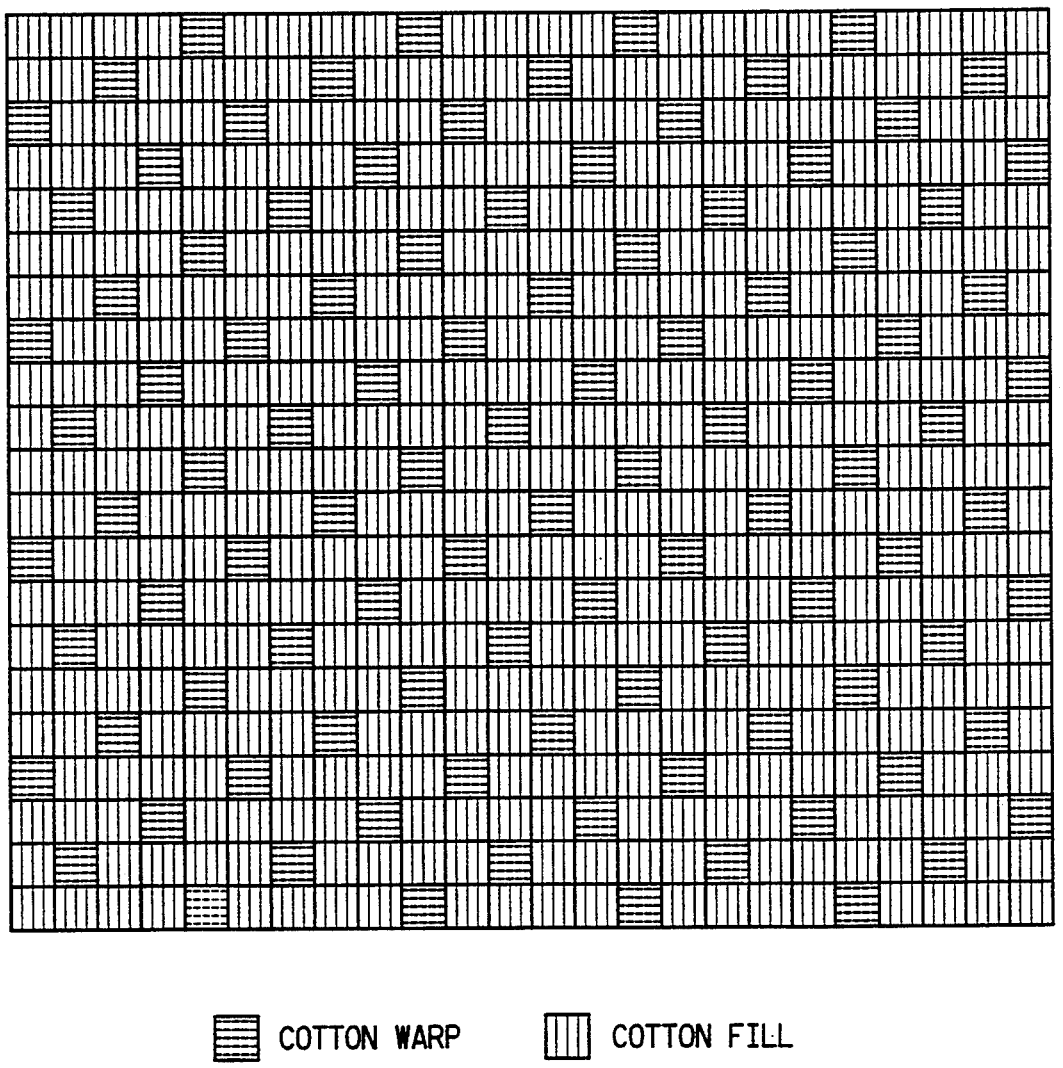
FIG. 1 depicts the weave pattern of the background fabric. Blocks containing horizontal dashed lines represent the warp yarns. Blocks containing the vertical solid lines represent fill yarns.

In the invention the reinforcing grid looks like a net or a web having greater separation between the warp yarns of the grid than between the yarns of the background fabric. The grid has both warp and fill yarns used as single yarn ends in forming the grid. The grid yarns are of generally of comparable denier to that of the yarns of the background fabric. It is preferred that the spacing of the yarns in the reinforcing grid be 5–15 ends per inch (2.54cm) in each the warp and the fill directions. It is also preferred to join the reinforcing fabric to the background fabric at points spaced from 4 to 30 per inch (2.54cm) in either the warp or the fill directions.

To achieve the increase in tear strength, the grid need be joined to only one face of the background fabric. A grid of the present invention may be joined to each face of the background fabric to make an even stronger reinforced fabric. When employing grids on each face of the background fabric, the spacing and the joining points of the grids need not be identical on each face, but can be varied to optimize properties of the reinforced fabric.

While yarns of the reinforcing grid can be of any strength that is greater than that of the background fabric, yarns from which the reinforcing grid is made are preferably selected to have a tenacity that is at least 1.5 times that of yarns the background fabric and an elongation that is at least 2 times that of yarns of the background fabric.

Preferably, and particularly for tent construction, the background fabric is a cotton sateen having at least 75 yarns per inch (2.54 cm) in the warp direction and at least 35 yarns per inch (2.54 cm) in the fill direction. It is also preferred that the reinforcing grid be made from MPD-I continuous multifilament yarn. A reinforced fabric made with this combination of reinforcing grid on one face of the background fabric and the cotton sateen as the background fabric will have a weight of 7.5 oz/y$^2$ (254 g/m$^2$) to 9.0 oz/y$^2$ (305 g/m$^2$). This reinforced fabric can be treated to be water and flame proof.

The preferred way to join the grid to the background fabric is during weaving. Just as in the background fabric, the reinforcing grid has yarns in the warp and fill directions. The reinforcing grid yarns in the fill direction are woven into the background fabric in the same way other fill yarns are woven in, that is by traveling up and over and around warp yarns and then down and through the plane of the weave of the background fabric. Single grid yarns in the fill direction pass from above the plane of the background fabric under and around at least one warp yarn of the background fabric then up through the plane and float over at least three warp yarns of the background fabric before they pass down and through the plane of the background fabric to continue repeating this pattern. Single reinforcing grid yarns in the warp direction pass from above the plane of the background fabric under and around at least one fill yarn of the background fabric then up through the plane and float over at least six fill yarns before they pass down and through the plane of the background fabric to continue repeating this pattern. This weaving construction forms a grid that is clearly visible only on one face of the background fabric. Even after any processing of the woven reinforced fabric such, as dying or pre-shrinking, the grid is visible and characteristic of the reinforcement of the present invention.

If the reinforcing fabric is placed only on one face of the background fabric, it will appear to be a net or a web attached to that one face of the background fabric. If the same weight percent of the reinforcing yarn is integrally woven into the background fabric, no web will be visible. Integrally woven means that yarns of reinforcing fiber replace a warp and a fill yarn of the background fabric. Although reinforcement will result from integrally weaving a reinforcing yarn into the warp and fill directions of the background fabric, the reinforced grid fabric of the present invention is at least 20% stronger as measured by Elmendorf Tear Strength than is a fabric reinforced by integrally weaving or knitting the same weight percent of MPD-I into the background fabric as is used in the reinforcing grid.

The detailed nature of the invention is best described with reference to the Figures. FIG. 1 depicts a typical background fabric, in this case it is of a weave known as a five harness satin. The background fabric can be of any weave appropriate and practical for the contemplated use. Examples of typical background fabric are Twills such as 2X1, 3X1, up to a pattern of 10X1; plain weaves; basket weaves and knits including circular or warp.

The five harness satin is preferred because it is a weave that already possesses good strength and can be reinforced to give a light weight highly serviceable fabric. Satin weaves can be more effectively treated chemically for water and flame proofing than a fabric of a plane weave in which warp and fill yarns cross in sequence one after the other.

Figure 3:
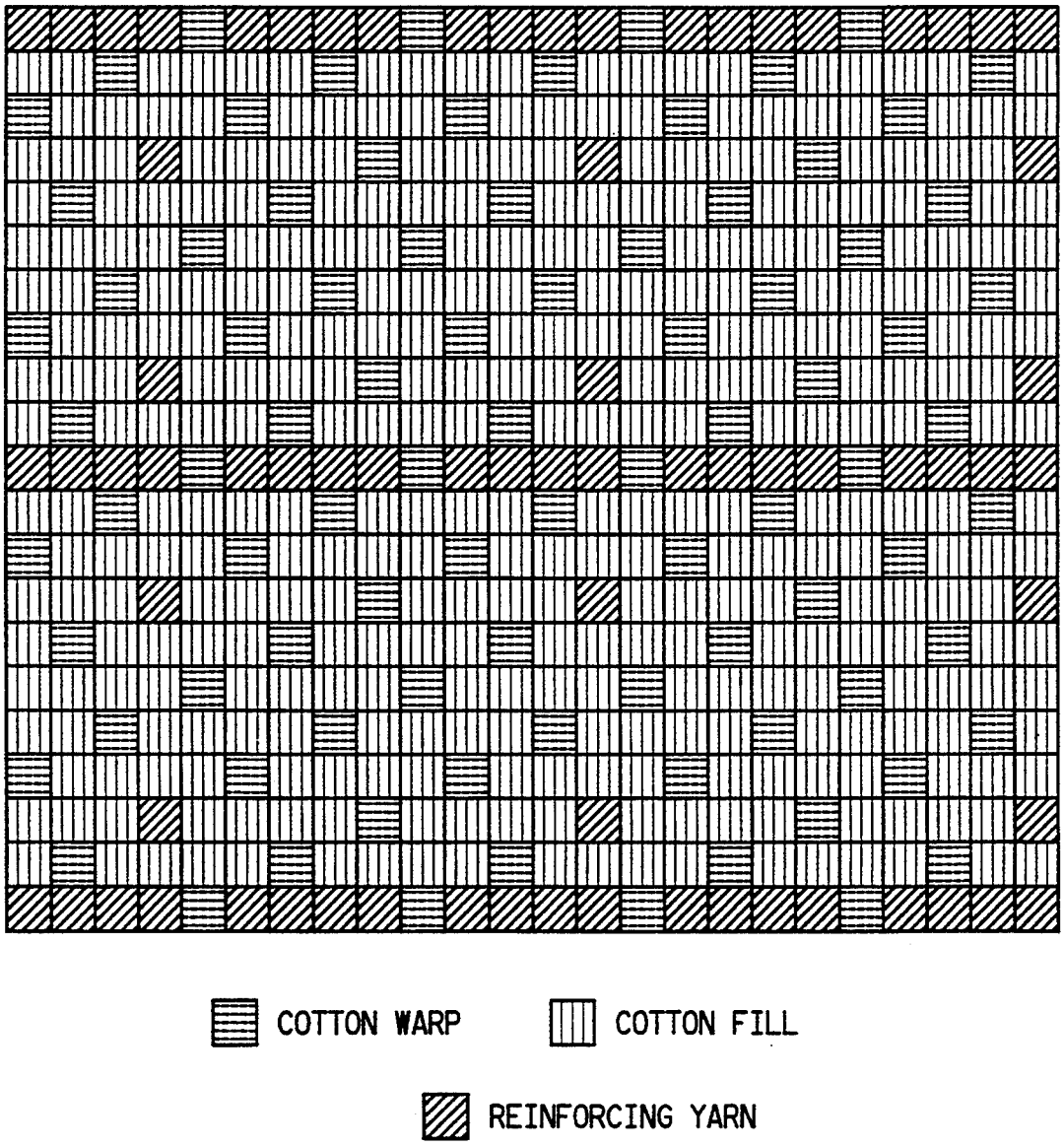
FIG. 3 depicts a control fabric in which the reinforcing yarns are integrally woven into the background fabric. The blocks containing horizontal dashed lines represent the warp yarns of the background fabric. The blocks containing diagonal lines represent the position of the reinforcing yarns. Blocks containing the vertical solid lines represent the fill yarns of the background fabric.

The control fabric is shown in FIG. 3. This is the same five harness satin weave of the background fabric except the reinforcing yarn has been substituted for a yarn of the background fabric in both the warp and fill directions so that the reinforcing yarn is integrally woven into the background fabric. A reinforcing yarn is located every tenth end and pick. Viewing this weave pattern the continuous multifilament reinforcing yarns are visible from each side of the reinforced fabric, but appears as any other yarn of the fabric.

Figure 2:
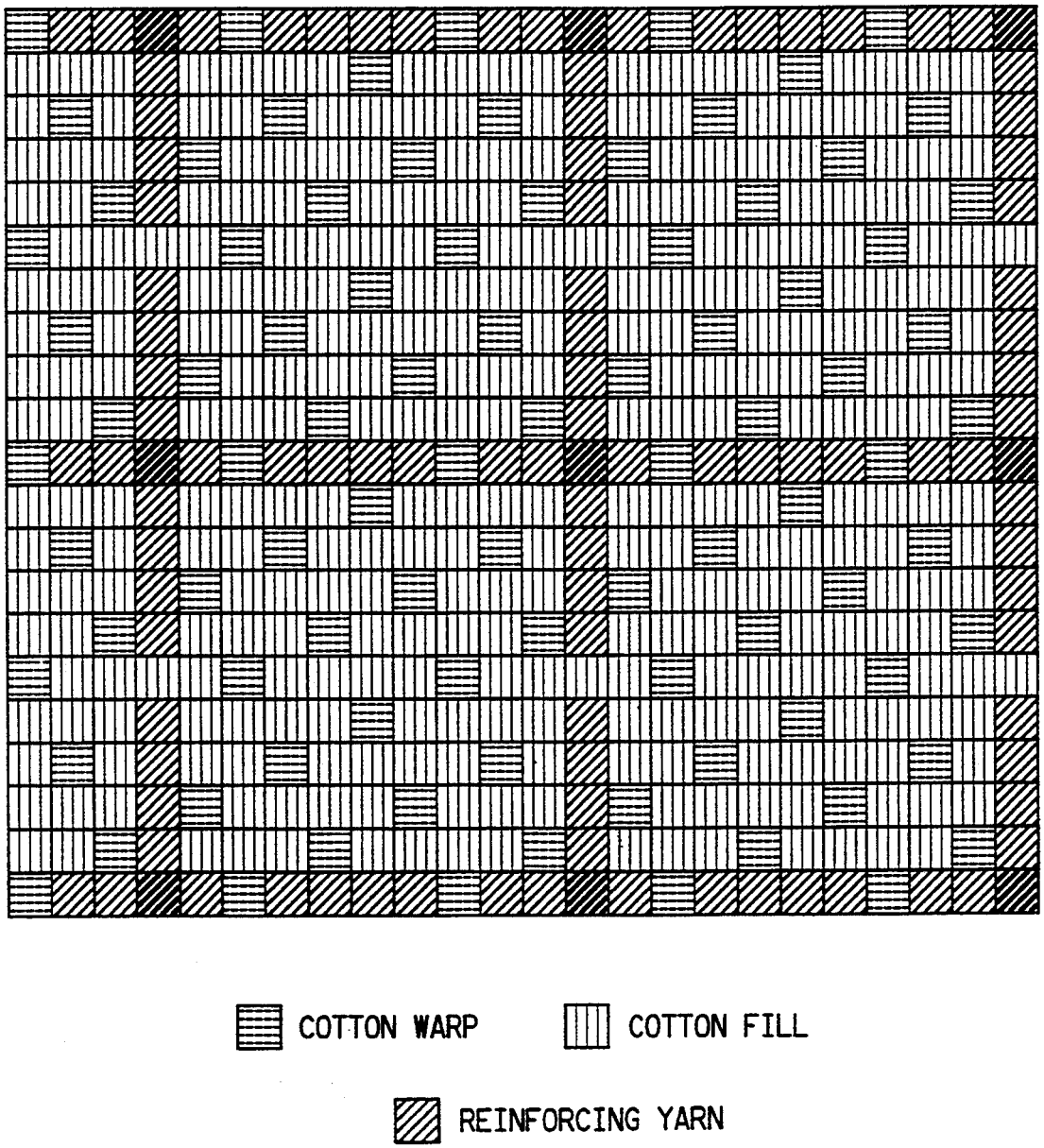
FIG. 2 depicts a reinforced fabric of the present invention and shows a reinforcing grid on the face of the fabric. Blocks containing horizontal dashed lines represent the warp yarns of the background fabric. Blocks containing diagonal lines represent the position of the yarns of the reinforcing grid. The blocks having the darker diagonal lines represent the cross over points of the reinforcing yarns. Blocks containing the vertical solid lines represent the fill yarns of the background fabric.

The reinforced fabric of the invention is shown in FIG. 2. The reinforcing grid is clearly visible. In the warp direction the reinforcing grid yarn is joined to the background fabric by the fill yarns of the background fabric. In the fill direction the reinforcing grid yarn is woven into the background fabric traveling the same path up, over under and through the plane of the weave as the fill yarns of the background fabric. The reinforcing grid warp yarns, placed in the reinforced fabric as they are, can be seen on only one face of the fabric. Not only are the grid warp yarns visibly discernible from the other yarns of the reinforced fabric, but they are also relatively more independent of the background fabric and more free to move in response to an applied force than are the yarns that are integrally woven into the background fabric. This extra mobility of the reinforcing grid yarns as compared to the mobility of the yarns woven into the background fabric causes the increase in tear resistance of the grid reinforced fabric allowing the reinforcing grid yarns to bunch up at the point of highest stress and provide resistance to the tear forces.

Reinforcement is particularly effective when the reinforcing yarn and the yarn of the background fabric are matched for their relative tenacity and break elongation. As noted above, it is preferred that the reinforcing yarn have at least 1.5 times the tenacity and at least 2 times the break elongation of the yarn from which the background fabric is woven. It is this combination of tenacity and break elongation that is essential to add both strength and toughness to the reinforced fabric. Matched pairs of reinforcing yarns and background fabrics are MPD-I and cotton, nylon and cotton, polyester and cotton. Generally a natural fiber background fabric, typically cotton, can be matched with a synthetic such as MPD-I, nylon or polyester to achieve excellent reinforcement.

Reinforcement background fabric arises when a filament yarn of higher tenacity is substituted for a warp yarn and a fill yarn of the background fabric. Since these higher strength yarns have been substituted for lower strength yarns of the background fabric, the tear strength of the fabric increases because the fabric contains yarns that are more difficult to tear or break.

The reinforcing grid offers an even greater increase in tear resistance than simple substitution of stronger yarns for weaker ones. The increase in tear strength is due to more than just the presence of the continuous multifilament yarn in the background fabric. It is related to the placement and the mobility of the reinforcing yarns of the grid.

EXAMPLE

A reinforced tent fabric was woven according to MILC-12095G (a five harness satin weave) from combed cotton using a 40/2 cotton count yarn except the weave was modified so that a grid of reinforcing Nomex T432, (from E. I. du Pont de Nemours & Co Inc.), 200 denier continuous multifilament was joined to one face of the background fabric. The grid was joined to the background fabric during the weaving process and is depicted in FIG. 2. In the warp direction, the grid yarn is present at the equivalent of every tenth end and pick although it is not integrally woven in to the fabric. In the fill direction the grid yarn is present at every tenth end and pick.

A control fabric was woven according to MILC-12095G except that a Nomex T432, 200 denier continuous multifilament yarn was substituted for every tenth end and pick of the background fabric weave pattern. This fabric is depicted in FIG. 3.

Each fabric, the control and the reinforced grid fabric made according to the invention, contained MPD-I reinforcing yarn at a weight percent of 7.7%.

Comparison of the properties and tear resistance of each fabric is given in Table I. Air permeability was determined by Textest type FX 3300 air permeability tester(Textest AG of Zurich Switzerland), tensile strength was determined by ASTM D5034 and tear resistance was determined by ASTM D1424, the Elmendorf Test.

Table I: Comparison of Properties and Performance of Reinforced Cotton Tent Fabric to that of the Control Tensile and Tear strength are reported in each the warp, W, direction and in the fill, F, direction.

| Property | Fabric Type | |
|---|---|---|
| | Reinforcing Grid | Control |
| Weight, oz/yd$^2$ | 7.4 | 7.3 |
| Ends × Picks | 100 × 85 | 100 × 85 |
| Weight % MPD-I | 7.7 | 7.7 |
| Breaking Strength, Pounds W/F | 107/93 | 108/93 |
| Tearing Strength, Pounds W/F | 20/20 | 15/15 |

The reinforced fabric was coated with water and flame resistant coatings as required by MILC-12095G. The following comparative properties were measured.

TABLE II Comparison of Properties and Performance of Coated Reinforced Cotton Tent Fabric to that of the Coated Control Tensile and Tear strength are reported in each the warp, W, direction and in the fill, F, direction. Fabric coating is according to MILC-12095G.

| Property | Fabric Type | |
|---|---|---|
| | Reinforcing Grid | Control |
| Weight, oz/yd$^2$ | 7.4 | 7.3 |
| Ends × Picks | 97 × 74 | 94 × 76 |
| Weight % MPD-I | 7.7 | 7.7 |
| Breaking Strength, Pounds W/F | 125/88 | 125/79 |
| Tearing Strength, Pounds W/F | 28/40 | 13/10 |
| Air Permeability cu.ft/min/ft$^2$ | 11.4 | 9.8 |

We claim:

1. A reinforced fabric comprising a background fabric and a reinforcing grid of yarns wherein the reinforcing grid is joined at infrequently spaced points to at least one face of the background fabric, and wherein the reinforcing grid has the number of yarn ends per inch that is less than 15% that of the background fabric and is joined to the background fabric such that the resulting reinforced fabric is at least 20% stronger, as measured by Elmendorf Tear Strength, than a similar fabric wherein the same weight percent of the same reinforcing yarns are integrally woven into the background fabric.

2. The reinforced fabric of claim 1 wherein the reinforcing grid is joined to the background fabric such that yarns of the grid are spaced 5–15 ends per inch in each the warp and the fill directions and is joined to the background fabric at points spaced from 4 to 30 per inch in either the warp or the fill directions.

3. The reinforced fabric of claim 1 wherein reinforcing grid comprises yarns having a tenacity that is at least 1.5 times that of yarns of the background fabric and an elongation that is at least 2 times that of yarns of the background fabric.

4. The reinforced fabric of claim 1 wherein the background fabric is cotton sateen having a weight of 7.5 to 9.0 ounces per square yard and at least 75 yarns per inch in the warp direction and at least 35 yarns per inch in the fill direction and the reinforcing grid is poly(m-phenylene isophthalamide) continuous multifilament yarn spaced 5–15 ends per inch in each the warp and the fill directions.

5. The reinforced fabric of claim 4 wherein the cotton background fabric is treated to be waterproof and flameproof.

6. A reinforced fabric comprising a background fabric with warp and fill yarns woven in the warp and fill directions and reinforcing yarns wherein the reinforcing yarns in the fill direction repeatedly pass under and around at least one fill yarn of the background fabric and float over at least 3 fill yarns of the background fabric and the reinforcing yarns in the warp direction repeatedly pass under and around all least one warp yarn of the background fabric and float over at least 6 warp yarns of the background fabric and wherein the reinforced fabric is at least 1.2 times stronger in tear resistance as measured by Elmendorf Tear Strength than the background fabric.

7. The reinforced fabric of claim 6 wherein reinforcing fabric comprises yarns having a tenacity that is at least 1.5 times that of yarns of the background fabric and an elongation that is at least 3 times that of yarns of the background fabric.

8. The reinforced fabric of claim 6 wherein the reinforcing grid is joined to the background fabric such that yarns of the grid are spaced 5–15 ends per inch in each the warp and the fill directions and is joined to the background fabric at points spaced from 4 to 30 per inch in either the warp or the fill directions.

9. The reinforced fabric of claim 6 wherein the background fabric is cotton sateen having a weight of 7.5 to 9.0 ounces per square yard and at least 75 yarns per inch in the warp direction and at least 35 yarns per inch in the fill direction and the reinforcing grid is poly(m-phenylene isophthalamide) continuous multifilament yarn spaced 5–15 ends per inch in each the warp and the fill directions.

10. A fabric of claim 6 wherein the reinforced fabric is treated to be waterproof and flame proof.

* * * * *